US005785814A

United States Patent [19]

Tang et al.

[11] Patent Number: 5,785,814

[45] Date of Patent: Jul. 28, 1998

[54] SPOOL BUTT UNWIND SYSTEM

[75] Inventors: Catherine A. Tang, Federal Way; Ralph W. Healy, Kelso, both of Wash.

[73] Assignee: North Pacific Paper Corporation, Longview, Wash.

[21] Appl. No.: 747,345

[22] Filed: Nov. 12, 1996

[51] Int. Cl.[6] ..... D21F 1/36

[52] U.S. Cl. ..... 162/191; 162/4; 162/306; 162/189

[58] Field of Search ..... 162/4, 189, 191, 162/193, 275, 289, 306, 264

[56] References Cited

U.S. PATENT DOCUMENTS

| | | | |
|---|---|---|---|
| 4,410,315 | 10/1983 | Frye | 493/342 |
| 4,906,334 | 3/1990 | Evens | 162/264 |
| 5,045,154 | 9/1991 | Baluha | 162/353 |
| 5,635,030 | 6/1997 | Meschenmoser | 162/193 |

OTHER PUBLICATIONS

Hall, Donald D., Automated broke handling can improve finishing room operation, *Pulp and Paper*, Nov., 1981, pp. 130–133.

Libby, Terry L., Trim conveying, *Papermaker*, Oct., 1994, pp. 21–23.

Salmela, J. and Scott Perry, Trimvac trim–removal systems. *Tappi Proceedings*, (Atlanta) 90: 177–180 (1990).

*Primary Examiner*—Peter Chin
*Assistant Examiner*—Steven B. Leavitt

[57] ABSTRACT

The invention is an apparatus and method for unwinding the butt portion of a reel of paper from the reel spool and delivering it to a repulper. It consists of a floor mounted stand with appropriate cradling surfaces to hold the spool butt. An air jet manifold is located at floor level below the stand. Air jets from the manifold direct the sheet toward the repulper. As the sheet enters the repulper it is met by water showers that direct it into the opening of the repulper. Once the sheet is engaged by the air jets and water showers it is continuously unrolled by the force delivered by these devices acting against the sheet. An accelerating mechanism may be provided to begin unrolling the paper from the spool and a brake mechanism is useful for stopping rotation of the spool after all of the paper has been removed.

12 Claims, 1 Drawing Sheet

SPOOL BUTT UNWIND SYSTEM

The present invention is directed to apparatus and a method for transferring the butt portion of a paper reel remaining on a reel spool into a broke or repulping tank for recovery and recycling.

BACKGROUND OF THE INVENTION

Paper leaving the dryer section of a paper machine is normally taken up on rotating spools as large reels. These may be two meters or more in diameter, ten or more meters wide, and weigh many tons. When one reel has reached its desired weight or diameter the sheet is transferred to an empty reel where the process is continuously repeated. Full reels are transported to a finishing area, typically by overhead monorail or bridge cranes. At the finishing area the reels are longitudinally slit and rewound into smaller rolls which are of a length and diameter determined by the customer's specifications. At any given location on the reel, two or more rolls will usually be formed. Reels may occasionally be cut into rectangular sheets. Both rolls and cut sheets are usually then wrapped for protection during storage and shipping. Rolls may or may not have additional end sheets glued on for further protection against dirt and minor mechanical damage.

Many customers will not accept rolls containing breaks or splices. Reels are always sized initially with the customer's requirements in mind. This means that they must be made a bit wider and fuller to allow for end trim to provide neat, straight edges and to ensure that no breaks will be present in the ultimate rolls. At the rewinder the slitters will usually take from about 2–5 cm of trim off each edge. This is picked up by pneumatic conveyors which ultimately transport it to a broke chest where it is repulped for recycle back into the wet end stock. Examples of such conveying systems are well described in the literature and the systems are commercially available from a number of vendors. See, for example, the article by Terry Libby, *Papermaker*, October 1994, pp 21–23 or one by Donald D. Hall, *Pulp and Paper*, November 1981, pp 103–133. However, because of their width, spool butts; i.e., that portion of the paper left on the reel spool after the rolls have been slit and rewound, are not readily amenable to such treatment. These are usually manually removed by a worker using a utility knife. Full length transverse cuts are made through the remaining paper so that it can be peeled off the reel spool in narrow, full width strips. These are then manually picked up or dragged and thrown into a nearby repulper chest. This procedure presents several problems. It is labor intensive and the worker is subject to repetitive motion and lower back injuries and knife cuts. Also, cuts are frequently made into the covers of the reel spool requiring their replacement at a cost that will approach $20,000 on wide paper machines.

The problems just noted in handling spool butts are completely eliminated by use of the present invention.

SUMMARY OF THE INVENTION

The present invention is directed to a method and apparatus for handling paper spool butt portions in a rapid and safe manner that does not require significant manual labor. Any remaining butt portion of a reel is rapidly transferred into a nearby broke chest or repulper without the need for cutting it from the spool. The invention requires a floor mounted roll stand of appropriate width to accept the paper machine reel spools. This is located adjacent to a repulper for receiving the residual paper removed from the spool. The repulper will have an open top or other appropriate opening for receiving the full width of paper unrolled from the spool. This opening should be located below the longitudinal axis of the spool, generally about at floor level with the center of the opening lying on a projected line normal to the midpoint of the spool axis.

There will be at least one air jet manifold parallel to the spool axis. This is located at approximate floor level between the roll stand and broke chest. The air jet manifold serves two purposes. It is oriented to propel the sheet toward the broke chest and at the same time provide an essentially friction free fluid bearing for the sheet so that it does not scrape and drag across the floor during its transit distance. Further, once the sheet is initially placed in motion the air jets serve to automatically unroll the butt portion from the spool.

The term "floor level" should be understood to mean any planar surface on which the equipment might be mounted.

One or more water showers are located at the repulper to direct the sheet into the chest. Preferably, showers are located to act against both sides of the sheet as is enters the repulper. This gives additional energy to the sheet to assist in unrolling it from the spool in addition to directing it into the repulper.

To start the operation, one or two workers may begin manually unrolling the sheet from the butt portion so that it is picked up by the air jets and directed along the floor toward the entrance of the repulper. However, it is preferable to have some mechanical accelerating means of starting to unroll the sheet. This can be readily achieved by using a motor with a frictional contact roll or other form of clutch to begin the spool turning so that the sheet starts to unwind. A desirable arrangement is to have a motor with frictional contact roll that is translated or moved arcuately by a pneumatic cylinder or other equivalent means against the spool end or the paper butt portion. As an alternative to a pneumatic cylinder, a mechanical arrangement such as a toggling linkage may be employed to actuate the roll accelerator. After the sheet is supported and propelled by the air jets and engaged by the water shower, it is normally no longer necessary to use the accelerating device and it can be withdrawn. However, this may be required throughout the operation with some heavy basis weight paper or pulp sheets.

With a light weight sheet the spool rotational speed will normally rapidly increase as the paper is unrolled. Since the spools are quite heavy they possess considerable kinetic energy and will continue to rotate for some time after all of the sheet has been removed. It is convenient to have a brake mechanism to stop spool rotation. This can be mounted in similar fashion to the accelerating motor so that it can be translated or otherwise moved into frictional contact to stop the spool rotation. The empty spool is then picked off the roll stand by an appropriate crane and returned to the paper machine in readiness for forming another reel.

While it has been noted that the accelerating motor and brake are preferably translated against the spindle, it should be understood that these could be moved arcuately and the term "translated" should be read broadly enough to encompass this form of movement.

It is an object of the invention to provide a simple and effective means of removing paper mill reel butt portions into a convenient chest or tank for repulping.

It is another object to provide a such a means that does not involve the safety hazards present when the butt portion is removed manually.

It is a further object to provide an apparatus and method that, once started, operates automatically to transfer the butt portion into the receiving chest or tank.

These and many other objects will become readily apparent to those skilled in the art upon reading the following detailed description taken in conjunction with the drawings.

DETAILED DESCRIPTION OF THE PREFERRED EMBODIMENTS

Figures 1, 2:
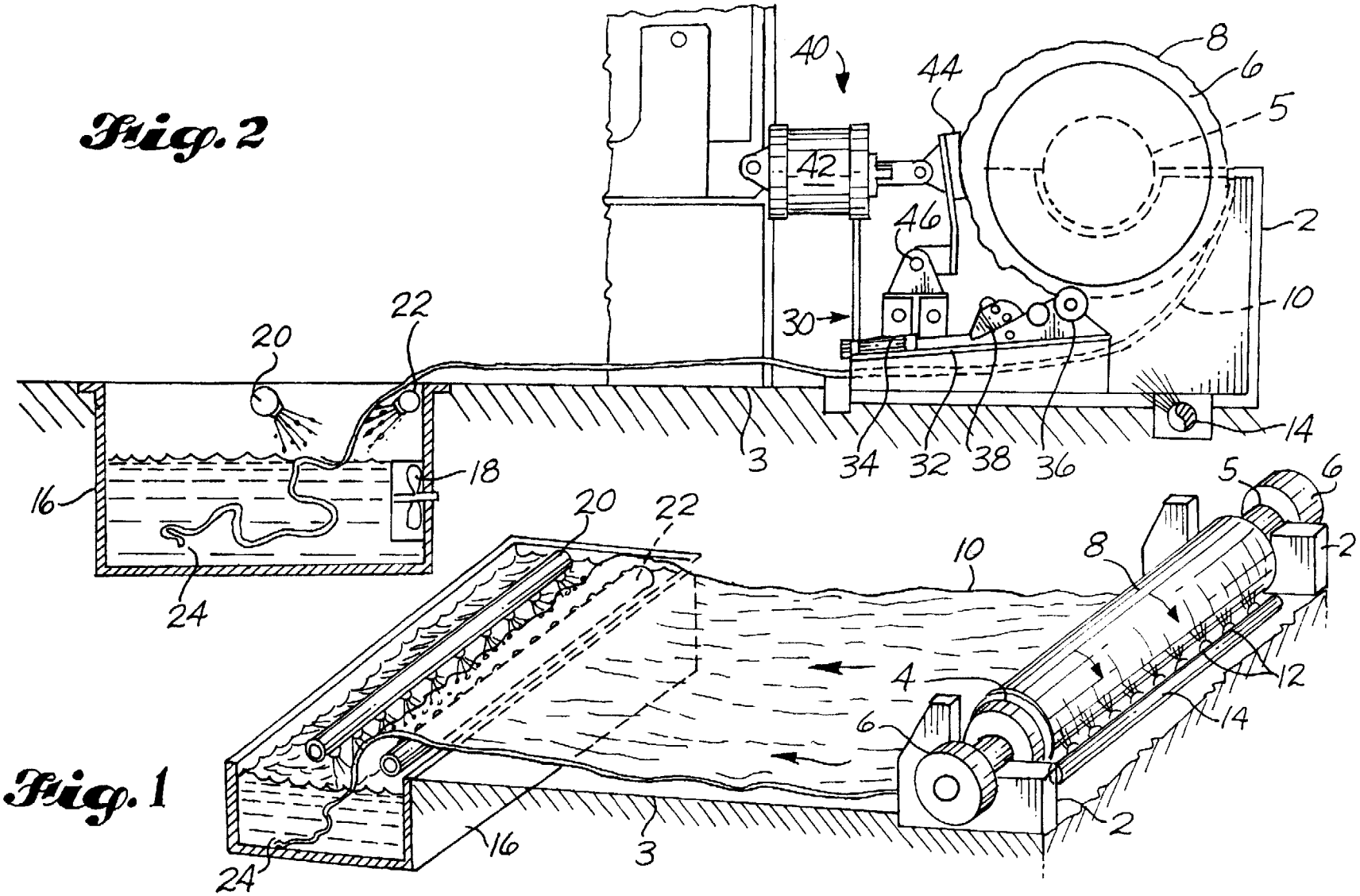
FIG. 1 is a perspective representation of the invention.
FIG. 2 is a side elevation partially in section.

Referring now to the figures, a spool stand 2 is provided on floor surface 3. The stand is configured with appropriate cradling saddles to accommodate the bearing surfaces 5 of a reel spool 4 having hub ends 6. The reel spool still contains the butt portion 8 of a reel of paper that has been mostly rewound. Spool 4 is turned clockwise in the configuration shown to begin unwinding the full width paper sheet 10. This is picked up by air jets from nozzles 12 on an air jet manifold 14 and directed toward the repulper. The curtain of air beneath the sheet provides an air bearing as the sheet is moved across floor surface 3 to the repulping chest 16 which is equipped with an appropriate agitator 18. If the distance between the spool stand and repulping chest is considerable, it is within the scope of the invention to provide one or more additional sets of air jets along the sheet pathway to maintain it in a near friction free suspension over the floor. As the sheet enters the repulping chest it is met by one or more water showers 20, 22 that serve to direct it into the repulping chest 16. There it is repulped into slurry 24 which is pumped back to be reused in the process as broke. Most preferably there are showers acting against both sides of the sheet.

The combined action of the air jets and water showers is generally to deliver sufficient force to continuously unroll the butt portion from the spool until it is completely unwound. However, since the mass is of the spool and contained paper or pulp is generally quite large some assistance is required to effect the initial unrolling action until the jets and showers can take over. While it is often possible to do this by hand, a mechanical assist is preferable. As seen in FIG. 2, a spool accelerator, generally shown at 30, consists of a frame 32 on which is mounted an actuating mechanism 34, such as a pneumatic cylinder. This serves to translate a friction drive 36, coupled to motor 38, into or out of contact with one of the hub ends 6 of reel spool 4. Accelerating mechanism 30 can normally be withdrawn after the sheet is subject to the air jets and water showers although its continuous use may be necessary under some circumstances.

By the time the last of the paper is withdrawn from the reel spool it has attained a high rotational speed. At this time a brake mechanism 40 is brought into play. An actuating cylinder 42 delivers a brake shoe 44 against spool hub 6 to stop roll rotation. The brake shoe moves arcuately around pivot point 46. When rotation has stopped the brake is then withdrawn and the spool can be picked up by an appropriate crane or lifting mechanism and the system is then ready for the next spool butt to be delivered.

While the inventors have described the best mode of construction and operation presently known to them it will be apparent to others skilled in the art that many variations not shown or described can be made in the mechanism and its operation without departing from the spirit of the invention. These should be considered to be within the scope of the invention if they lie within the boundaries defined by the following claims.

We claim:

1. Apparatus for transferring paper mill reel butt portions to a repulping tank which comprises:

a floor mounted roll stand for holding a reel spool containing a reel butt portion;

a repulper for receiving paper delivered from the reel spool, the repulper being displaced away from the floor stand and having a sheet receiving opening below the axis of the reel spool and essentially at floor level along a projected line normal to the midpoint of the spool axis;

at least one air jet transport means for propelling the sheet toward the repulper and creating an air bearing between the sheet and floor, said air jet means being located essentially at floor level; and shower means located at the repulper to direct and carry the sheet into said repulper, so that when the sheet is engaged by the air jet means and shower means the butt portion is continuously unwound from the spool by said air jet and shower means and delivered to the repulper.

2. The apparatus of claim I further including a spool accelerating means for initiating unrolling of the sheet from the reel spool.

3. The apparatus of claim 2 in which the accelerating means is motor driven with a frictional roll to engage the reel spool, said accelerating means being moveable against and away from said spool.

4. The apparatus of claim 1 which also includes brake means for stopping rotation of the reel spool after the paper is unwound.

5. The apparatus of claim 4 in which the brake means is movable against and away from the spool.

6. The apparatus of claim 1 in which the shower means comprises water showers to act against both sides of the sheet.

7. The apparatus of claim 1 in which an air jet means is located between the roll stand and repulper.

8. A method for transferring paper mill reel butt portions to a repulping tank which comprises:

providing a floor mounted roll stand for holding a reel spool containing a reel butt portion and placing a spool butt upon the stand;

supplying a repulper for receiving paper delivered from the reel spool, the repulper being displaced away from the floor stand and having a sheet receiving opening below the axis of the reel spool essentially at floor level along a projected line normal to the midpoint of the spool axis;

initiating unrolling of the sheet on the reel spool;

transporting the sheet toward the repulper by air jet means located essentially at floor level; and directing the sheet into said repulping tank by shower means located over the repulper, so that when the sheet is engaged by the air jet means and shower means the butt portion is pulled and unwound from the spool by said air jet and shower means and delivered to the repulper.

9. The method of claim 8 including providing an accelerating means to engage the reel spool and then moving said accelerating means against the spool to begin sheet unwinding.

10. The method of claim 9 in which the accelerating means is motor driven and has a fictional drive to engage the reel spool, said means being translatable against and away from said spool.

11. The method of claim 8 which also includes stopping rotation of the reel spool after the paper is unwound by a brake means.

12. The method of claim 8 in which an air jet means is located between the roll stand and repulper.

* * * * *